US005194165A

United States Patent [19]

Rattigan

[11] Patent Number: 5,194,165

[45] Date of Patent: Mar. 16, 1993

[54] FINISHING CAPS FOR CONCRETE FORMWORK

[76] Inventor: Dennis Rattigan, 3295 Maplewood Road, Victoria, British Columbia, Canada, V8P 3M4

[21] Appl. No.: 653,366

[22] Filed: Feb. 11, 1991

[51] Int. Cl.[5] ..... E04G 9/00

[52] U.S. Cl. ..... 249/188; 249/14; 249/34; 249/194

[58] Field of Search ..... 249/2-8, 249/13, 18, 34, 47, 48, 188, 192, 193, 194, 207, 208, 210, 219.1, 14, 189; 52/254, 276, 277, 278, 287, 288, 716, 732, 179

[56] References Cited

U.S. PATENT DOCUMENTS

| | | | |
|---|---|---|---|
| 537,047 | 4/1895 | Landis | 52/254 |
| 1,394,790 | 10/1921 | Roughsedge | 249/193 |
| 2,206,493 | 7/1940 | Whatling | 249/194 |
| 2,306,722 | 12/1942 | Fox | 249/157 |
| 3,206,806 | 9/1965 | Powell | 52/288 |
| 3,244,395 | 4/1966 | Arrighini | 249/194 |
| 3,782,680 | 1/1974 | Hopkins | 249/188 |
| 4,192,113 | 3/1980 | Martin, Jr. | 52/732 |
| 4,729,541 | 3/1988 | Maier | 249/194 |
| 4,768,320 | 9/1988 | Weller | 52/732 |
| 4,976,401 | 12/1990 | Carlson | 249/194 |

*Primary Examiner*—Jay H. Woo
*Assistant Examiner*—James P. Mackey
*Attorney, Agent, or Firm*—Beveridge, DeGrandi, Weilacher & Young

[57] ABSTRACT

A finishing cap for concrete formwork is described herein for providing smooth finished concrete joints and corners while reducing the time, labor, expense, and expertise required to make such a joint. The finishing cap provides two non-parallel edges forming an angle, wherein the concrete formwork is fitted into the angle so provided. The angle between the edges of the finishing cap is provided so as to be somewhat smaller than the final desired angle of the finished concrete joint. A pinching action is created between the edges of the finishing cap and the formwork, and this pinching action prevents stones and concrete from entering the joint and roughing up the final finished joint. After the concrete is poured, smoothed and set, the finishing cap may be easily removed and a smooth finished corner is produced. The invention is described in relation to concrete formwork for stairs and walls.

12 Claims, 7 Drawing Sheets

FINISHING CAPS FOR CONCRETE FORMWORK

BACKGROUND OF THE INVENTION

The invention relates to a device for producing smooth finished concrete corners and joints, while reducing the time, labor, expense and expertise required in making such a corner or joint. This invention is particularly related to concrete joints between the tread and the riser of stair steps and concrete corners of walls.

In the current method of making concrete formwork for producing steps, as shown in FIG. 1, the formwork 100 for the riser of the step is typically made from a wooden plank, such as a 2×8 or a 2×10. This plank 100 is typically attached to the sides of the formwork by nailing. As the concrete is poured, the surface for the tread of the step 102 is levelled and smoothed by trowelling with a trowel 104. To allow enough room for the trowel 104 to smooth the joint more closely to the corner, the edge of the formwork plank 100 is typically ripped at an angle, shown at 106. This angle 106 is typically approximately 45°. However, because of the appreciable thickness of the trowel 104 and the riser formwork, it is not easy for the trowel 104 to smooth the concrete all of the way up to the final finished corner, as shown by the open space 108 between the formwork 100 and the trowel 104. There will always be some loose stone or concrete which floats into the open space 108 and is not removed with the trowel 104 These stones and concrete make the finished joint rough and aesthetically undesirable. An experienced concrete finisher can limit this roughing to some extent, but this requires a great deal of time and experience in concrete work, which increases the costs. Furthermore, it takes extra time to rip the formwork 100 at the angle 106, thus ruining the 2×8 or 2×10, which also increases the costs.

If the concrete is of poor quality, for example, either too pasty, too watery, or already beginning to set up, it becomes even more difficult and more time consuming to produce a smooth finished joint Weather conditions, such as rain, can cause puddles and deteriorate the finish of the concrete joint During vibration of the steps, for properly settling of the concrete, the joints can be deteriorated. Furthermore, it may be necessary to re-trowel the treads and re-smooth the corners, thus adding additional time, labor and expense Improper vibration can cause honeycombing at the joints, which provides an undesirable finished joint.

Likewise, when producing concrete walls, the corners of the formwork are formed by nailing two sheets of plywood together to form a corner joint. If these corner joints are not held tightly together, stones and concrete work their way into the corners, especially after numerous pourings of concrete, thus loosening the joint. The final corners appear rough and uneven, which detracts from the appearance of the finished corner.

SUMMARY OF THE INVENTION

It is one objective of this invention to provide a device for producing smooth concrete corners and joints, while reducing the time, labor, expense and expertise needed for producing the finished product.

One main objective of the invention is to provide a fast and efficient way to finish stair treads simply, while producing a smooth joint between the riser and tread of stair steps.

It is a further objective of this invention to provide a device for producing a smooth corner for a concrete wall.

These and other advantageous objects of this invention are achieved by providing a finishing cap which fits over the concrete formwork joint at the corner. The finishing cap has two non-parallel edges which join together to form an angle, and the concrete formwork is fitted into this angle. The angle formed by the edges is somewhat smaller than the desired angle of the finished concrete product. In this manner, when the formwork is fitted into the finishing cap, the edges of the cap pinch tightly against the formwork to hold it tightly together and/or to prevent stones and concrete from working into the joint or corner and roughing up the finished concrete joint or corner. The finishing cap is made from a rigid, but deformable material, such as plastic, polyethylene, latex rubber, fiberglass, PLEXIGLAS (thermoplastic polymers, such as methyl methacrylate-type polymers), metal, wood, or the like, so that the finishing cap pinches tightly on the concrete formwork. The concrete formwork may be secured to the finishing cap by nails, screws, glue, adhesive, or other fastening means.

One embodiment of the invention is a stair cap for securing the riser formwork for producing a concrete step. The stair cap provides a smooth corner between the tread of the lower step and the riser In this embodiment, the stair cap is provided with two edges for tightly holding the riser formwork at the appropriate angle to produce the appropriate nosing. Furthermore, the stair cap edge extends beyond the riser formwork such that smoothing and trowelling of the tread is easier and quicker. When the stair cap is used, only a very small and almost unnoticeable trowelling edge is made where the concrete on the tread is smoothed along the edge of the cap. In the stair cap, the concrete is poured directly against the stair cap structure.

Another embodiment of the invention is a wall cap for providing smooth corners In this embodiment two formwork sides are joined together at a corner between two non-parallel edges of the wall cap. The wall cap pinches against the formwork and is then fastened. Concrete is poured against the caps, which prevents corner joints and seams from becoming rough, but rather provides smooth finished joints and seams.

The finishing caps in accordance with this invention are reusable, but made from a material such that they are inexpensive enough so they may be discarded without incurring great expense.

BRIEF DESCRIPTION OF THE DRAWINGS

The advantageous features of this invention will be apparent from the following detailed description, taken in conjunction with the accompanying drawings, wherein like reference numbers correspond to the same element throughout the various views, in which.

DETAILED DESCRIPTION OF THE INVENTION

The illustrations and dimensions given throughout this specification correspond to the preferred embodiments of the invention. They are intended to be illustrative of the invention and in no way limiting.

The invention relates to a device for making smooth concrete joints in a simple, quick, clean and inexpensive manner. As discussed above, concrete formwork is typically made from wooden planks or plywood. When making a corner of concrete, such as at a concrete wall corner or at the riser of a step, the wooden planks must be joined together to form a corner. If the wooden planks at the joints are not held tightly together, after concrete is poured into the form, stones and concrete work their way into the joint resulting in rough corners after the concrete has set.

This invention relates to a concrete "finishing cap" which is used to hold the concrete formwork tightly in place, and thereby enabling a smooth corner to be poured quickly and easily. Furthermore, the smooth edges are made with a minimum amount of work and time by a professional concrete worker, therefore saving money and time in the construction.

Figure 1:
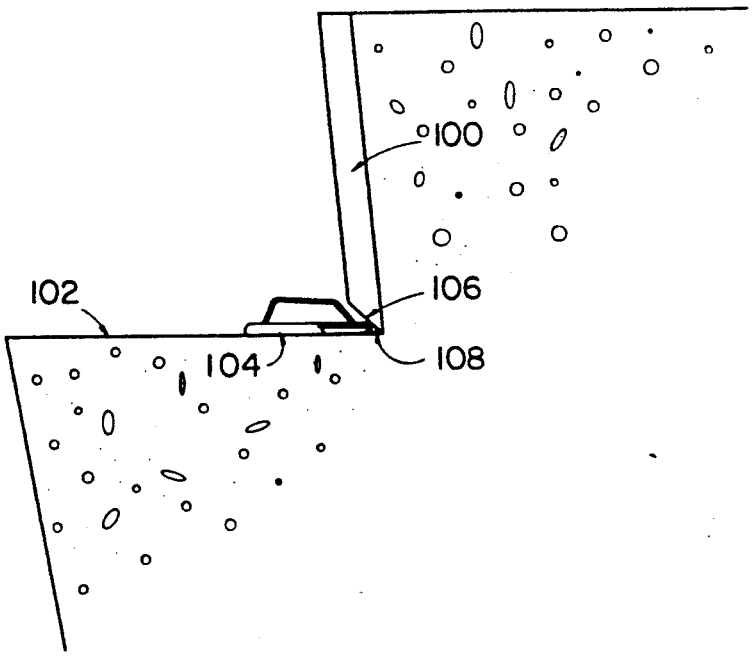
Fig. 1 (Prior Art)
FIG. 1 shows the prior art formwork for a concrete step.
Figure 2:
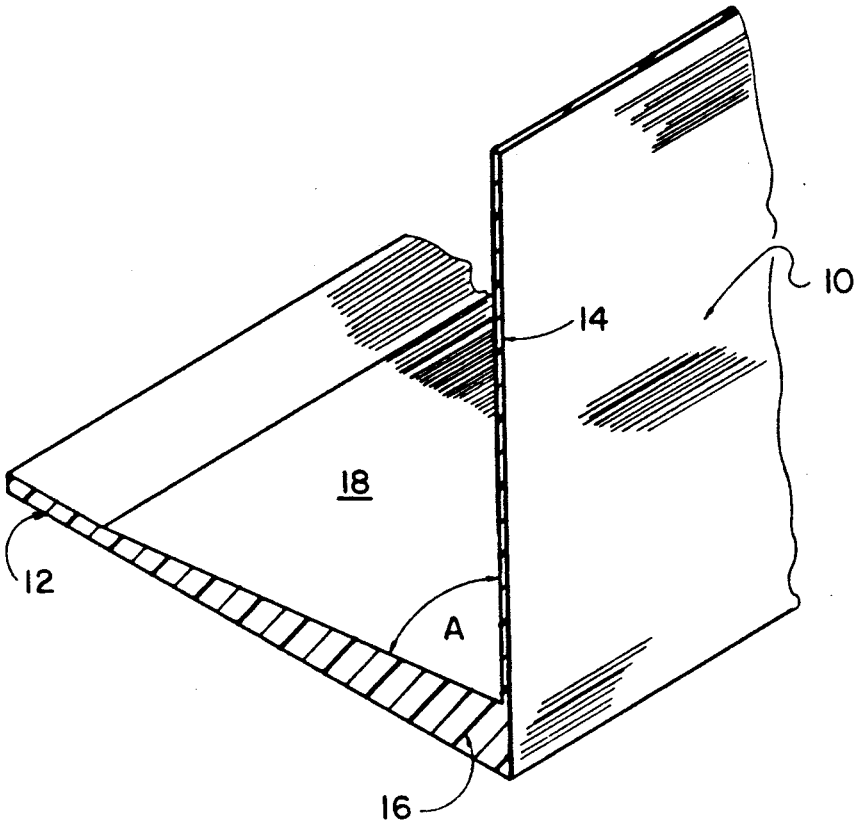
FIG. 2 shows a first embodiment of a stair cap in accordance with the invention.

FIG. 2 shows a partial view of an embodiment of the invention for use as a "stair cap", shown generally at 10. In the preferred embodiment of the invention, the stair cap is produced from a single piece of material. A variety of materials may be used for the stair cap body, such as plastic, latex, rubber, fiberglass, PLEXIGLAS (thermoplastic polymers, such as methyl methacrylate-type polymers), metals, paper, or wood. The important features in the stair cap is that the body is rigid, but deformable, so that the concrete formwork will be tightly held in position by the pinching force of the edges of the cap. It is also advantageous for the stair cap to be made from a strong and durable material so it may be reused often, but still an inexpensive material such that it may be discarded without a great financial loss. It is believed that polyethylene or other inexpensive plastic materials are best suited for the finishing caps in accordance with this invention, because of their strength, thinness, and flexibility.

As shown in FIG. 2, the stair cap 10 includes a first edge 12 which will rest along the top horizontal surface of the lower step, and the bottom surface of edge 12 is level with the tread of this step. In the preferred embodiment, the first edge 12 is typically 2 to 2 ½ inches long and about 1/32 inch thick. The stair cap will extend along virtually the entire width of the step, thereby forming a smooth concrete joint along the entire width of the step. The method of using the stair cap will be described in more detail later in this specification.

A non-parallel side edge 14 is provided, thereby defining the angle A between the edges 12 and 14, which angle is made to be somewhat smaller than the desired angle of the finished concrete joint. For example, for a typical step, the riser is usually at an angle of about 82°; therefore, if the angle A is about 75° to 80°, this will maintain a tight pinching action on the concrete formwork when it is inserted into the angle A formed by the edges 12 and 14. In one embodiment of the invention, the edge 14 is approximately 2 inches long and about 1/32 inch thick.

It is generally desired that stairs have a riser which is not perfectly vertical, thus making a "nosing", which makes the stairs easier and safer to climb and aesthetically more pleasing. To create this nosing, the first edge 12 of the stair cap includes a slanted or inclined portion 16 which is used to hold the riser formwork at an angle, thus forming a concrete riser which is not perpendicular to the horizontal surface of the stair, but rather deviates the riser from the vertical direction. Therefore, the top surface 18 of the edge 12 is not parallel to the surface of the step on which it rests. Accordingly, stairs with a non-vertical angled riser can be produced, thereby providing a nosing. This inclined portion 16 obviates the need to rip the edge of the riser formwork at an angle The inclined portion 16 may be typically about 9/32 inches thick at its thickest portion, near the side edge 14.

Figure 3A:
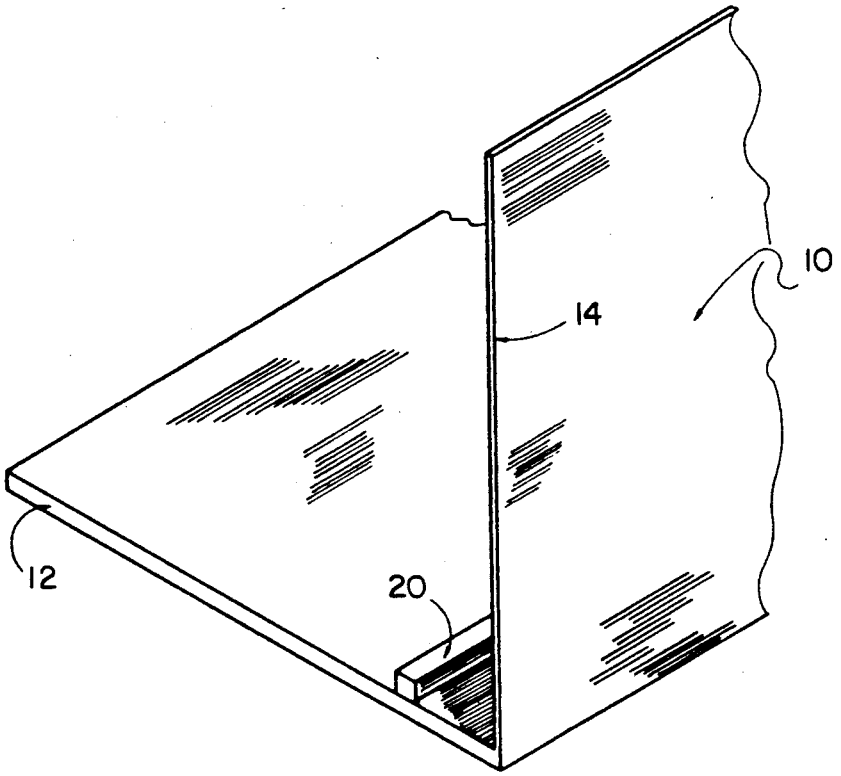
FIG. 3A shows a second embodiment of the stair cap in accordance with the invention.
Figure 3B:
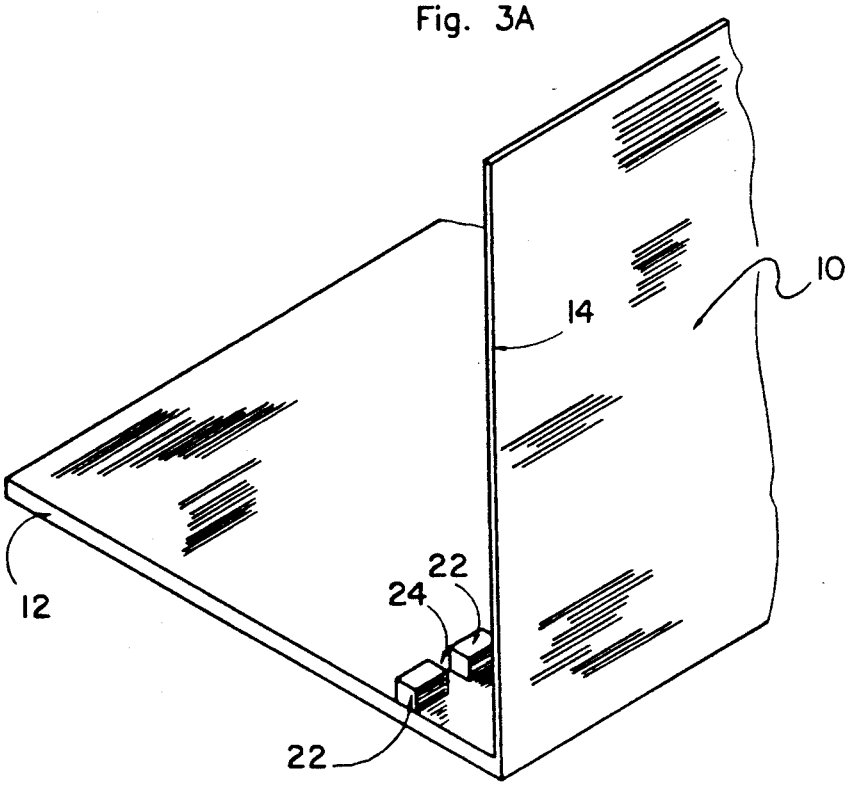
FIG. 3B shows a variation of the embodiment of FIG. 3A.

An alternative means for providing this nosing is shown in FIG. 3A. Instead of providing an inclined surface portion, a raised ledge 20 is provided along virtually the entire length of the stair cap. The raised ledge 20 may typically be about ⅛ inch high and ⅛ inch wide, and positioned approximately ½ inch from the side edge 14 of the stair cap 10. This positioning of the ledge 20 corresponds to a 7/1 riser to nosing ratio. The position and height of the ledge 20 could obviously be changed to accommodate any desired riser to nosing ratio. This embodiment has an advantage over the embodiment of FIG. 2, in that there is a substantial savings in material of construction when this embodiment is used. Additional construction materials may be saved, as shown in FIG. 3B, wherein a plurality of shorter ledges 22 are provided along the entire length of the stair cap 10. Intermittent spaces 24 are shown between the ledges. Various other shapes and patterns of ledges or inclined portions may be used without departing from the invention. The important feature is that an angled riser is provided so that a nosing is made on the finished step. Alternatively, instead of providing an inclined portion 16 or raised ledges 20 and 22, as shown in FIGS. 2, 3A and 3B, the bottom edge of the riser formwork may be ripped at an appropriate angle so as to provide the nosing angle.

Figure 4:
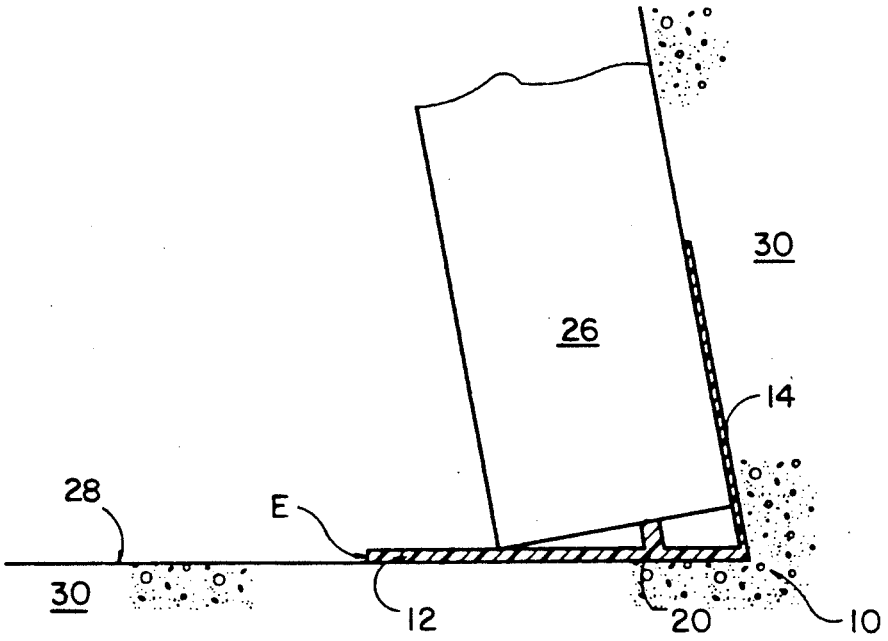
FIG. 4 shows a side view of the embodiment of FIGS. 3A and 3B, with concrete formwork fitted into the stair cap.

FIG. 4 shows the stair cap 10 with a wooden riser formwork 26 fitted into the angle formed by the edges 12 and 14. Typically, the riser formwork 26 is a wooden plank, such as a 2×6 or a 2×8, which runs along the entire width of the step to be formed. When the angle between edges 12 and 14 is somewhat smaller than the final desired angle of the concrete structure, the formwork 26 is tightly pinched into position between edges 12 and 14, and it is placed at the proper angle by the raised ledge 20. This raised ledge 20 obviates the need to rip the riser formwork edge at an angle, thus saving time, material, and money. The formwork 26 is held into position on the stair cap 10 by means of nails, glue, adhesives, silicone or other similar fastening means.

In one preferred method of using the invention, the formwork for an entire set of steps may be made and placed in the proper position. This formwork will include sidewalls (not shown) to contain the cement in the form when poured, and a riser formwork 26 and stair cap 10 assembly in position at each step level. The edges of the stair cap 10 and/or the formwork 26 will be secured to the sidewalls of the stair form by means of nails, screws, adhesives, silicone bonding, glue or other fastening means. The concrete may be poured into the form to fill area 30, and the steps will be formed from the bottom to the top. As the concrete reaches the level of the tread of a step 28, the top of the step 28 is smoothed by trowelling. Furthermore, vibration of the formwork can be performed so as to properly settle the wet concrete into the form, thus preventing voids in the concrete The poured cement at the top surface 28 is smoothed and trowelled level up to the edge 12 of the stair cap 10. The excess concrete will be simply trowelled level near the bottom of the stair cap edge 12. Difficult finishing and trowelling steps are eliminated, which saves time in finishing the stairs, with lesser expertise required, while providing a smooth, consistent finish to the joint. Since the edge 12 of the stair cap 10 extends beyond the side of the formwork 26, there is no need to force the trowel into the corner to smooth the corner. The corner is already smooth because the wet concrete is against the smooth stair cap 10. The distance which the cap edge 12 extends beyond the riser may be changed, according to the thickness of the riser or the material of which the stair cap is made. Even with a very flexible and thin trowel edge 12, the concrete pressure will not effect the tread finish. The finisher just trowels straight across riser formwork 26, and the trowel edge will extend beyond the riser only minimally It may be advantageous to pour a few steps, and then wait for a short time to allow the cement to partially harden, before pouring additional steps. As an added advantage, the stair cap will protect the joint from inclement weather.

A very thin trowel line E will be created where the wet cement is smoothed and trowelled along the edge 12 of the stair cap 10. This trowel line E will be barely noticeable on the finished step, and if an appropriate degree of care is used in finishing the steps, this groove will be almost unnoticeable. The trowel line E may be ground off if a very smooth finished step is desired, although this is not generally necessary.

After the cement has set, the sidewalls of the formwork may be removed The stair cap 10 and riser formwork 26 assembly may be removed from the finished step by simply peeling the stair cap 10 from the top surface 28 of the step.

The above method is advantageous in that the entire set of stairs may be formed at one time. The concrete joint between the stair tread and the riser is smooth because the tight pinching action between the edges 12 and 14 of the stair cap 10 and the riser formwork 26 prevents stones and concrete from working into the joint and roughing up the finished surface.

In an alternative method of using the invention, the formwork and stair cap may be secured onto the horizontal surface of a previously formed and hardened step 28, for example, by means of an adhesive between the underside of edge 12 and the horizontal surface of step 28, and fresh concrete may be poured in area 30, thereby providing the nosing and the riser for the step. The surface 28 is not necessarily a previously step, but may be the floor of the building or a sidewalk, other surface on which the steps are being built. In this method of using the invention, each step may be individually formed and at least partially set before the next step is formed. After the concrete is poured, the upper surface of the step is smoothed, and the concrete in area 30 will be allowed to harden, thus forming the nosing and riser of the step. After the concrete is hardened, the formwork 26 and the stair cap 10 may be removed from the lower step by peeling it off and reused immediately on top of the step just formed The concrete joint thus formed is very smooth, because the tight pinching action of the stair cap 10 on the formwork 26, which prevents concrete and stones from entering the joint and roughing up the joint. Accordingly, a smooth joint is provided with a minimal amount of time, labor, and expertise in masonry work The stair cap 10 and formwork 26 should be immediately reusable on the next step with a minimal amount of repair or reworking of the combination. Edge 12 is simply fixed to the surface 28, and the next step may be made. This method is advantageous in that a single stair cap 10 and riser formwork assembly may be used.

Figure 5:
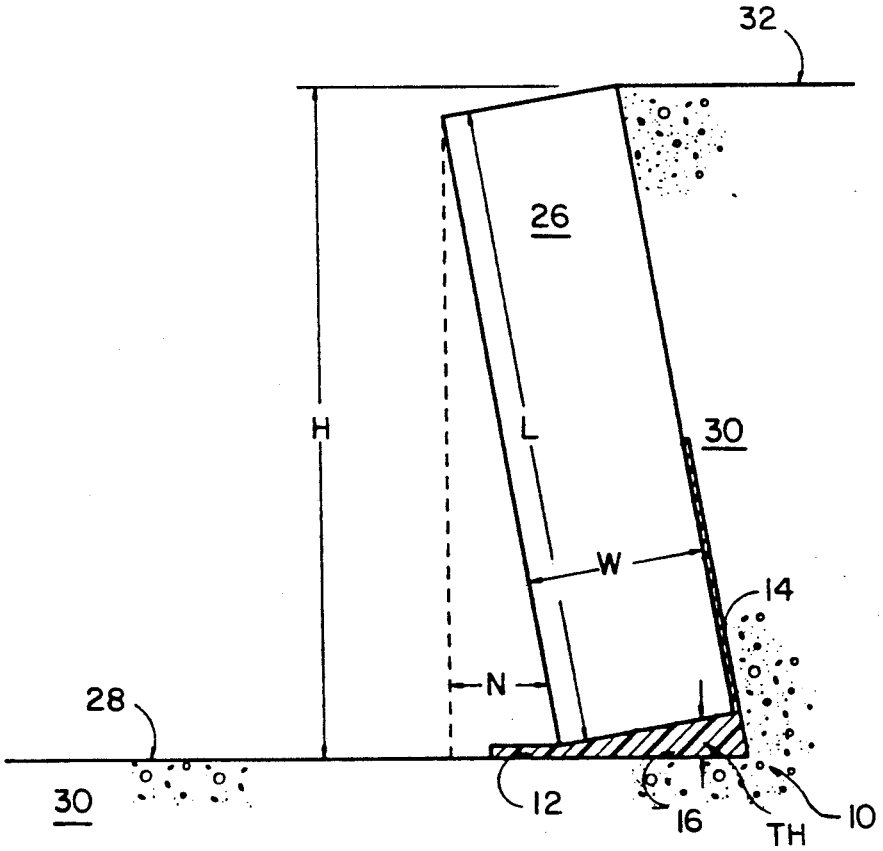
FIG. 5 shows a side view of the embodiment of FIG. 2 with concrete formwork fitted into the stair cap.

FIG. 5 shows the stair cap embodiment 10 of FIG. 2, with the riser formwork 26 fitted into the angle formed between the edges 12 and 14. A typical step has approximately a 7 inch high riser, shown as dimension "H", and about a 1 inch nosing, shown as dimension "N", which corresponds to a riser to nosing ratio of 7:1. The riser formwork 26 is ripped to the appropriate width, secured into the stair cap 10, fixed to the top of the surface 28 or to the sidewalls of the formwork, and the joint is ready to receive concrete in the area 30. The area 30 forms the step and the riser of the step after the concrete has hardened. The top surface 32 of the formed step must be smoothed and levelled after the concrete has been poured, as described above.

If a 7 inch vertical riser height and a 1 inch horizontal nosing is desired for the final step, the length of the riser formwork 26 can be easily calculated by using the following equation:

$$H^2+N^2=L^2,$$

wherein L is the length of the riser. For the step specifications described above, $$\text{li}=(H^2+N^2)^{\frac{1}{2}} \text{ or } (50)^{\frac{1}{2}}$$

$$L=7.07 \text{ inches.}$$

Therefore, the riser formwork 26 must be ripped to a length of 7.07 inches to provide a step with these specifications.

The appropriate angle of the finished riser may be calculated from the following geometrical relationship:

$$Angle=Tan^{-1}(H/N)$$

$$Angle = Tan^{-1}(7)$$

$$Angle = 81.9°,$$

wherein Angle is the desired angle of the final riser. Since the final desired angle is about 82°, providing a stair cap 10 with an angle A (see FIG. 2) of about 75° to 80° will provide a tight pinching force against the riser formwork 26.

In the embodiment of FIG. 5, the angle is provided by using the inclined portion 16 to place the formwork 26 on an angle. Assuming that this type of formwork is made from a 2×8 or 2×10 (which are actually 1.5 inches wide, shown as dimension "W"), the maximum thickness of the inclined portion 16 can be approximated from the following geometric relationship:

$$Th = cos\ (Angle) \times (W)$$

$$Th = (cos\ 81.9) \times 1.5$$

$$Th = 0.21 \text{ inches},$$

wherein

Th is the maximum thickness of the inclined portion

Angle is the final desired angle

W is the width of the formwork.

As shown in the above calculation, the maximum thickness of the inclined portion 16 is about 0.2 inches, near edge 14, and the inclined portion 16 thickness tapers to the thickness of the edge 12.

The above calculations are merely exemplary and directed to a preferred final step product. The desired angle, riser to nosing ratio, nosing width, and riser height in the finished step may be changed at the preference of the builder. Likewise, the angle of the stair cap itself may be changed, depending on factors such as the rigidity or flexibility of the stair cap material used and the degree of pinching desired. Such modifications of these dimensions are deemed to be within the skill in the art.

There will be occasions when a piece of lumber wide enough for a riser, such as a 2×8 or a 2×10, will not be available, or alternatively, because of cost considerations, it may be undesirable to rip this wide lumber to the appropriate width for concrete formwork. If a 2×6 is the widest formwork which is available without ripping a 2×8 or a 2×10, the stair cap 10 in accordance with this invention can still be advantageously used, as shown in FIG. 6.

A piece of ¾ inch plywood 34 is cut to the appropriate width for use as the formwork for the riser. The plywood 34 is attached (via nailing, adhesive or other method) to a conventional 2×6 36, to increase the strength of the formwork. This type of formwork may be desirable, because plywood is less costly than 2×8's and 2×10's. In this manner, none of the quality lumber (2×6's, 2×8's or 2×10's) is cut, nor is the quality lumber in direct contact with the concrete.

The thickness and size of the inclined portion may be changed to accommodate any stair dimensions. Also, the thickness of the inclined portion may be adjusted to change the degree of pinching or to change the riser angle or nosing width.

Figure 6:
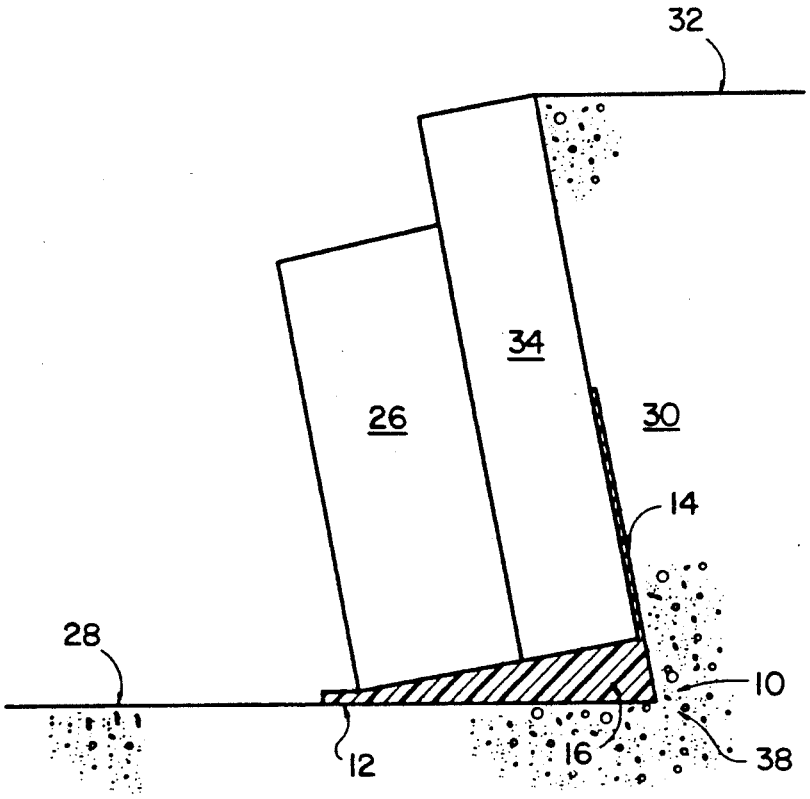
FIG. 6 is a similar view to FIG. 5, showing the use of this invention with another type of riser used as the concrete formwork.

FIG. 6 shows another feature of the invention which may be used at the discretion of the builder The very corner of the concrete joint is shown rounded off at 38 in FIG. 6. It is possible to have rounded corners, square corners, or various other corner shapes without departing from this invention.

Figure 6A:
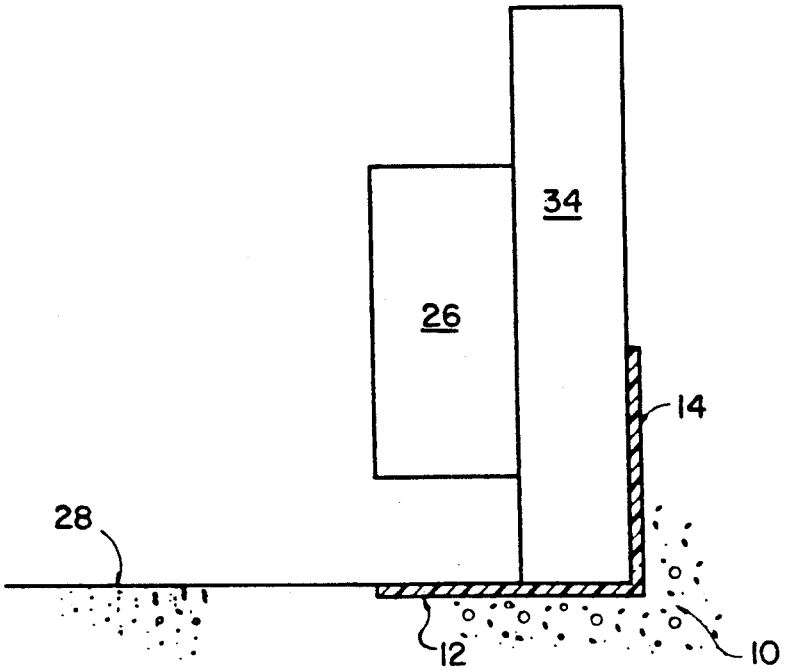
FIG. 6A shows an alternative embodiment of the stair cap shown in FIG. 6.

An alternative embodiment of the stair cap of FIG. 6 is shown in FIG. 6A. FIG. 6A shows the stair cap 10 in which the angle of the riser is 90 degrees. As shown in this embodiment, a plywood riser 34 is supported by a 2×4 (reference number 36) and held in place in the stair cap 10 by means of nails, adhesives, screws, silicone bonding, glue, or other fastening means.

Figure 7:
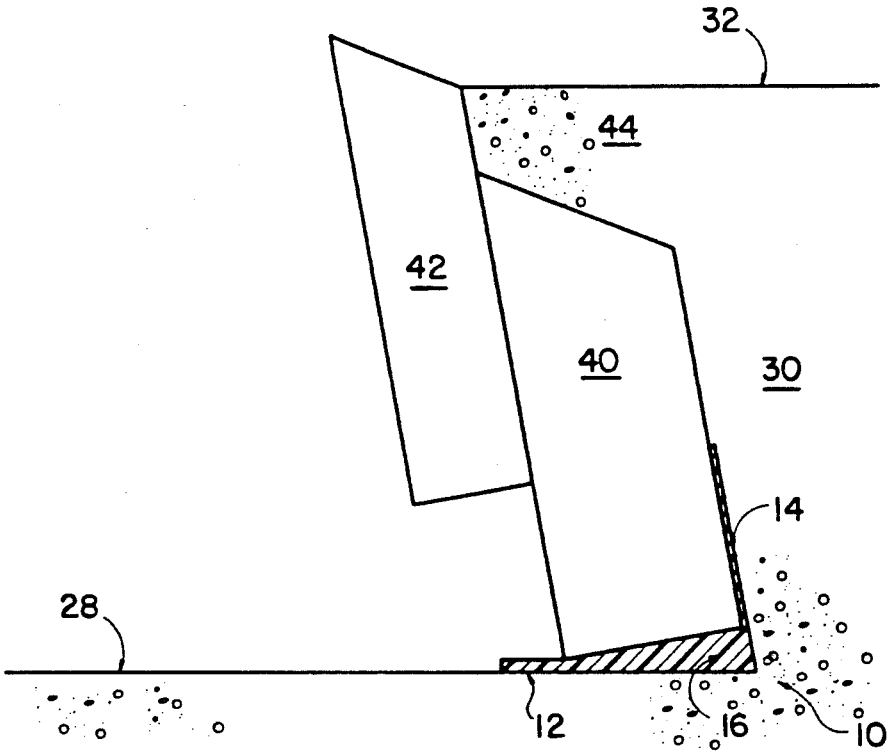
FIG. 7 shows the use of the invention wherein the concrete formwork provides an alternative nosing design for the finished concrete step.

Another use for the stair cap 10 in accordance with the invention is shown in FIG. 7. In this embodiment, two riser portions 40 and 42 are secured together and shaped in such a manner so as to provide an extended nosing section 44 or a prenosing section. The stair cap is used in the manner described above in relation to FIGS. 4–6. Any desired nosing or riser design may be used in accordance with this invention, depending on the aesthetic preference of the builder.

Figure 7A:
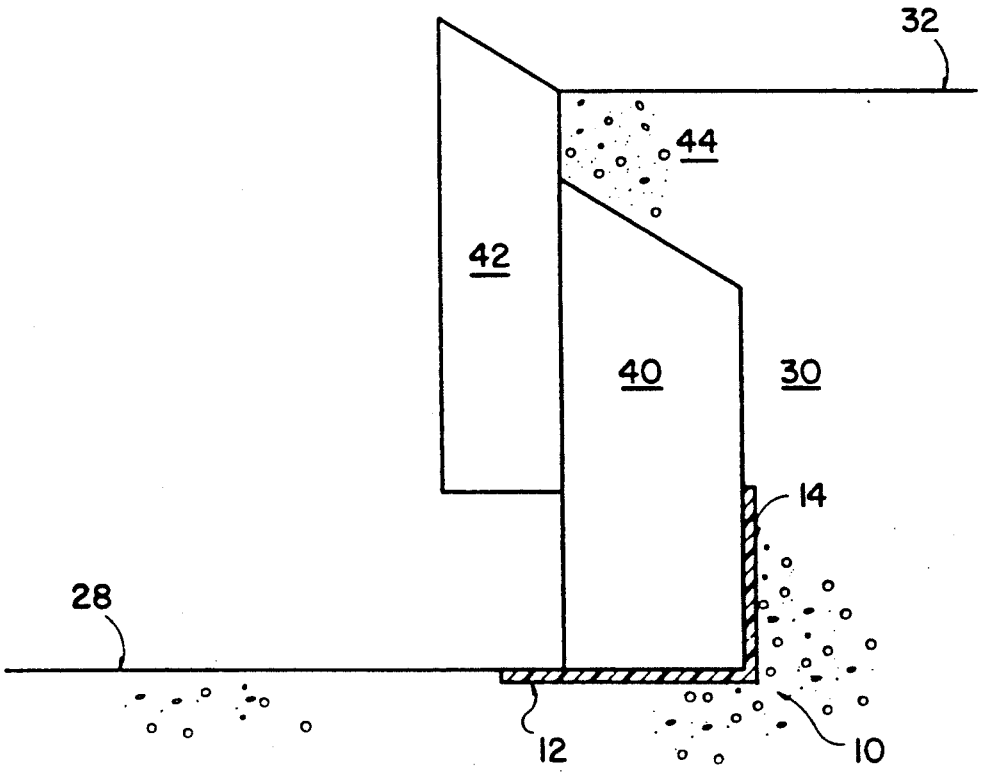
FIG. 7A shows an alternative embodiment of the stair cap of FIG. 7.

Alternatively, as shown in the embodiment of FIG. 7A, the edge 45 of riser portion 40 may be designed to be essentially perpendicular to surface 28. In this manner, only the riser portion 42 would provide the extended nosing section 44. Such modifications to the riser design are deemed to be within the scope of this invention.

Another embodiment of the invention is shown in FIGS. 8–11. This embodiment of the invention is for use with concrete formwork for making concrete walls. Concrete is poured in area 52 against these caps which eliminates the seams of the plywood forms 50 and prevents concrete from entering the joints, thereby producing a smooth, nice finish. Additional formwork for the outer edge of the wall is shown at 56. The formwork for the outer edge of the wall 56 may be held in place by a wall cap, if desired The finishing caps are shown in exaggerated size at 60 in FIG. 8. These caps will be shown and discussed in more detail in conjunction with FIGS. 9 and 10. After the concrete has set, the formwork 50 is removed and the wall is formed. If, during pouring, concrete or stones get into the corners of the joints, rough corners result, which are aesthetically unpleasing.

Figure 9:
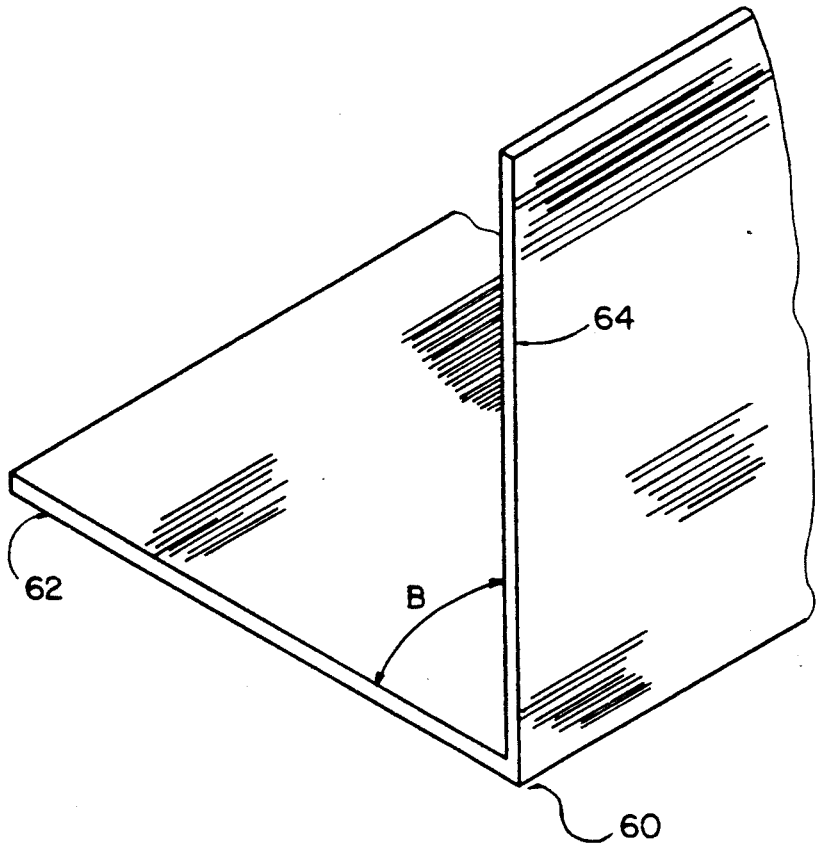
FIG. 9 shows an embodiment of the invention used for holding the formwork for concrete walls.

The wall cap in accordance with this invention is shown generally at 60 in FIG. 9. The wall cap works on the same principle as the stair cap described above, wherein the angle "B" of the wall cap is formed somewhat smaller than the final desired angle of the finished concrete structure. The wall cap 60 is made from a rigid, but deformable material such that a tight pinching action acts on the formwork when it is fitted into the angle B. This provides a tight joint between the formwork, even after several pourings of concrete into the form. As shown in FIG. 9, the wall cap 60 is made from two non-parallel walls 62 and 64 which may be about 2 inches long and 1/32 inches thick. As discussed in relation to the stair cap, the wall cap is preferably formed from a single piece of rigid, but deformable material which runs along virtually the entire length of the formwork joint The same materials may be used for the wall cap as used for the stair cap.

Figure 8:
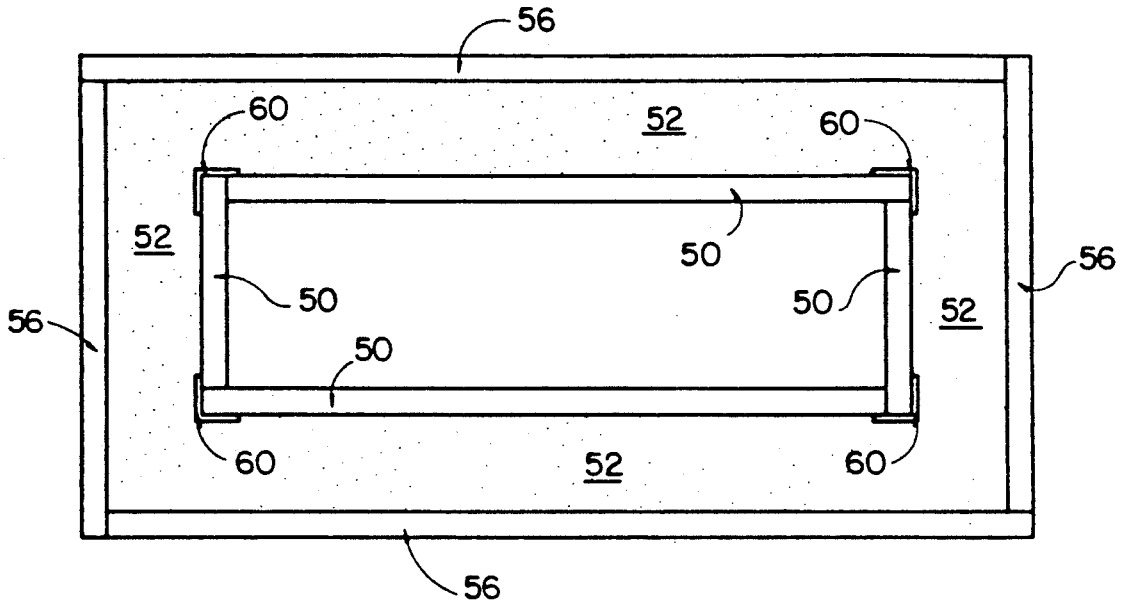
FIG. 8 shows concrete wall formwork for use with another embodiment of the invention.
Figure 10:
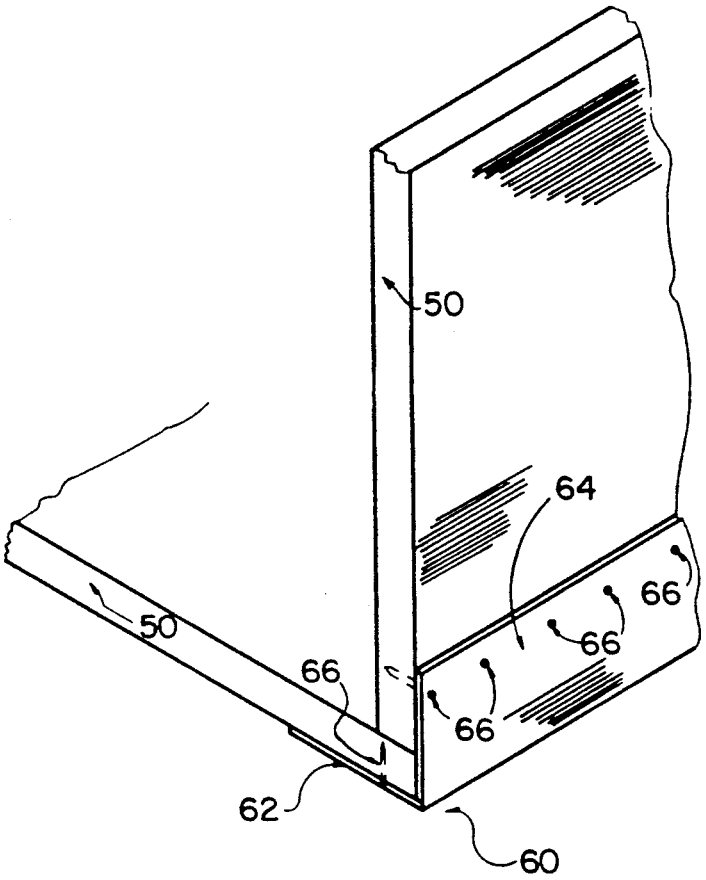
FIG. 10 shows an enlarged portion of a corner of FIG. 8, showing the wall cap of the invention relative to the concrete formwork.

The use of the wall cap 60 can be seen more clearly in FIG. 10, which is an enlarged perspective view of one of the corners 54 in FIG. 8. Typically, walls are desired wherein the corner of the wall is at an angle of 90°. To provide such an angle, it may be desirable to manufacture the wall cap 60 with the angle B (FIG. 9) at about 80°. This will provide an adequate degree of pinching, and a smooth corner is provided with the rough spots eliminated.

The wall cap 60 may be secured to the formwork 50 by nails, shown at 66. Alternatively, the wall cap 60 may be secured to the formwork 50 by means of an adhesive or other suitable fastening means. Suitable adhesives are commercially available, and the particular choice of adhesive is a matter of preference to the user and within the skill of the art.

Figure 11:
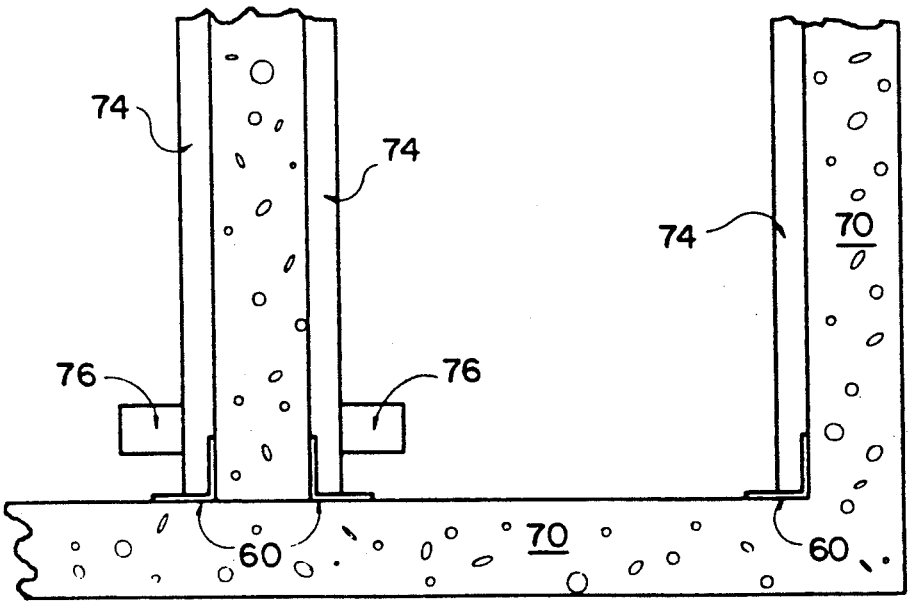
FIG. 11 shows the stair cap for use in pouring monolithic concrete walls.

Another variation on the wall cap design and its use is shown in FIG. 11. The wall cap 60 may be used when pouring monolithic concrete walls. In FIG. 11, the wall cap 60 is used at the joint between the middle wall 72 and the main concrete walls 70, and at the joint of the walls 70. In this embodiment, plywood 74 is used as the concrete formwork, and 2×4 wedges 76 are shown to hold the formwork for the middle wall 72 securely in place. Again, the finished concrete joints are provided quickly, with less labor and expertise, and the finished joints are smooth and aesthetically pleasing.

Both the stair cap and the wall cap may be made from plastic materials in the preferred embodiment, such as polyethylene. These polyethylene polymer materials are strong and rigid, yet inexpensive and simple to manufacture. The stair cap and wall cap may be made, in the preferred embodiment, by extruding the polymeric material through an appropriately shaped die. Such manufacturing techniques are well known to those skilled in the art. The finishing cap may then be produced in the form of a roll which can be cut off to the desired length, such as, the overall width of the step or the height of the wall. The finishing cap is secured into position by nails, screws, glue, adhesives, silicone or other fastening means.

While the invention has been described in conjunction with various specific and preferred embodiments, various modifications may be made without departing from the invention as defined in the following claims.

What is claimed is:

1. An apparatus for forming concrete for providing smooth, finished concrete corners or joints when concrete is poured against a form that is secured in a finishing cap, comprising:

a finishing cap, and concrete formwork;

said finishing cap including a body formed from two non-parallel edges joined at a corner and forming an angle, each edge extending essentially the entire length of the corner, whereby said corner is adapted to receive said concrete formwork fitted into said corner formed by said two edges, wherein each edge has an upper surface and an underside, said concrete formwork being secured in said corner, wherein said body is formed from a substantially rigid but deformable material, and said angle of said corner being smaller than a desired angle of the finished concrete corner or joint, so as to pinch the formwork firmly into said corner, thereby providing a smooth corner or joint, such that concrete is poured to form the smooth finished corner or joint, whereby concrete contacts the underside of each if said edges, the upper surface of one of said edges including means for placing the formwork at a position which deviates from a direction perpendicular to the underside of said one edge, and said means for placing the formwork at a position which deviates from a direction perpendicular to the underside of said one edge including a raised ledge along said upper surface of said one edge.

2. An apparatus as claimed in claim 1, wherein said raised ledge extends essentially the entire length of said one edge.

3. An apparatus as claimed in claim 1, wherein the body of the finishing cap is made from a single piece of rigid, deformable material.

4. An apparatus as claimed in claim 1, wherein the underside of one of said edges is placed adjacent to an essentially horizontal surface of a step, wherein the formwork for a riser for a next step is fitted into said corner.

5. An apparatus as defined in claim 1, wherein said finishing cap is attached to the formwork with nails.

6. An apparatus as defined in claim 1, wherein said finishing cap is attached to the formwork with an adhesive.

7. An apparatus as defined in claim 1, wherein said rigid but deformable material is plastic.

8. An apparatus for forming concrete for providing smooth, finished concrete corners or joints when concrete is poured against a form that is secured in a finishing cap, comprising:

a finishing cap, and concrete formwork;

said finishing cap including a body formed from two non-parallel edges joined at a corner and forming an angle, each edge extending essentially the entire length of the corner, whereby said corner is adapted to receive said concrete formwork fitted into said corner formed by said two edges, wherein each edge has an upper surface and an underside, said concrete formwork being secured in said corner, wherein said body is formed from a substantially rigid but deformable material, and said angle of said corner being smaller than a desired angle of the finished concrete corner or joint, so as to pinch the formwork firmly into said corner, thereby providing a smooth corner or joint, such that concrete is poured to form the smooth finished corner or joint, whereby concrete contacts the underside of each of said edges, the upper surface of one of said edges including means for placing the formwork at a position which deviates from a direction perpendicular to the underside of said one edge, and said means for placing the formwork at a position which deviates from a direction perpendicular to the underside of said one edge including a plurality of raised ledges extending along said upper surface of said one edge.

9. An apparatus as claimed in claim 8, wherein said raised ledges are collinearly arranged, extending essentially the entire length of the upper surface of said one edge.

10. An apparatus for forming concrete for providing smooth, finished concrete corners or joints when concrete is poured against a form that is secured in a finishing cap, comprising:

a finishing cap, and concrete formwork;

said finishing cap including a body formed from two non-parallel edges joined at a corner and forming an angle, each edge extending essentially the entire length of the corner, whereby said corner is adapted to receive said concrete formwork fitted into said corner formed by said two edges, wherein each edge has an upper surface and an underside, said concrete formwork being secured in said corner, wherein said body is formed from a substantially rigid but deformable material, and said angle of said corner being smaller than a desired angle of the finished concrete corner or joint, so as to pinch the formwork firmly into said corner, thereby providing a smooth corner or joint, such that concrete is poured to form the smooth finished corner or joint, whereby concrete contacts the underside of each of said edges, said angle being about 75° to 80°, and said desired angle of the finished concrete corner or joint being about 82°.

11. An apparatus for forming concrete for providing smooth, finished concrete corners or joints when concrete is poured against a form that is secured in a finishing cap, comprising:

a finishing cap, and concrete formwork;

said finishing cap including a body formed from two non-parallel edges joined at a corner and forming an angle, each edge extending essentially the entire length of the corner, whereby said corner is adapted to receive said concrete formwork fitted into said corner formed by said two edges, wherein each edge has an upper surface and an underside, said concrete formwork being secured in said corner, wherein said body is formed from a substantially rigid but deformable material, and said angle of said corner being smaller than a desired angle of the finished concrete corner or joint, so as to pinch the formwork firmly into said corner, thereby providing a smooth corner or joint, such that concrete is poured to form the smooth finished corner or joint, whereby concrete contacts the underside of each of said edges, said angle being about 80°, and said desired angle of the finished concrete corner being about 90°.

12. An apparatus for forming concrete for providing a smooth, finished concrete corner or joint, comprising:

a finishing cap and concrete formwork;

said finishing cap including a body formed from two non-parallel edges joined at a corner and forming an angle, each edge extending essentially the entire length of the corner, whereby said concrete formwork is adapted to be fitted into said corner formed by said two edges, wherein said body is formed from a substantially rigid but deformable material, said angle of said corner being small than a desired angle of the finished concrete corner or joint, so as to pinch the formwork firmly into said corner, thereby providing a smooth corner or joint along which concrete may be poured, and wherein an upper surface of one of said edges includes a means for placing the formwork at a position which deviates from a direction perpendicular to an underside of said one edge, and wherein said formwork comprises a stair riser form adapted to fit into said corner such that the cap is secured to the form, wherein the upper surface of said one edge which includes the placing means abuts a bottom end of the form, and the other edge abuts a face of the form.

* * * * *